US005420374A

United States Patent [19]

Hotta

[11] Patent Number: 5,420,374

[45] Date of Patent: May 30, 1995

[54] ELECTRONIC MUSICAL INSTRUMENT HAVING DATA COMPATIBILITY AMONG DIFFERENT-CLASS MODELS

[75] Inventor: Harumichi Hotta, Hamamatsu, Japan

[73] Assignee: Yamaha Corporation, Japan

[21] Appl. No.: 842,046

[22] Filed: Feb. 26, 1992

[30] Foreign Application Priority Data

Mar. 1, 1991 [JP] Japan ..... 3-036427

[51] Int. Cl.[6] ..... G10H 1/06

[52] U.S. Cl. ..... 84/622

[58] Field of Search ..... 84/622-625, 84/601, 602, 626-633

[56] References Cited

U.S. PATENT DOCUMENTS

| | | | |
|---|---|---|---|
| 4,147,083 | 4/1979 | Woron et al. | 84/622 |
| 4,512,230 | 4/1985 | Ezawa et al. | 84/626 |
| 4,898,059 | 2/1990 | Iizuka | 84/601 |
| 5,063,820 | 11/1991 | Yamada | 84/622 X |
| 5,134,919 | 8/1992 | Kunimoto | 84/622 |

FOREIGN PATENT DOCUMENTS 59-197090 11/1984 Japan .

*Primary Examiner*—Stanley J. Witkowski

*Attorney, Agent, or Firm*—Graham & James

[57] ABSTRACT

An electronic musical instrument has a data compatibility with respect to different models of the electronic musical instruments such as the beginner's model and pro model. In order to match the musical tone control data used in one model with the other musical tone control data used in another model, there is provided a conversion table which memorizes a relationship between them. By referring to this conversion table, certain musical tone control data made by one model is converted into the musical tone control data which can be used in another model. Thus, every model can generate musical tones by use of the musical tone control data which are converted suitably for itself. For example, the musical tone control data represents the tone color of the musical tone to be generated.

6 Claims, 12 Drawing Sheets

| NUMBER | TONE COLOR NAME | CONVERTED TONE COLOR No. (EACH MODEL | | | |
|---|---|---|---|---|---|
| | | BEGINNER'S MODEL | PRIMARY-CLASS MODEL | MIDDLE-CLASS MODEL | HIGH-CLASS MODEL |
| 1 | STRINGS 1 | 1 | 1 | 1 | 1 |
| 2 | VIOLIN 1 | 2 | 2 | 2 | 2 |
| ⋮ | ⋮ | ⋮ | ⋮ | ⋮ | ⋮ |
| 25 | CONTRABASS 1 | 25 | 25 | 25 | 25 |
| 26 | STRINGS 2 | 1 | 26 | 26 | 26 |
| 27 | PIZZICATO STRINGS | 1 | 27 | 27 | 27 |
| ⋮ | ⋮ | ⋮ | ⋮ | ⋮ | ⋮ |
| 50 | PIZZICATO BASS | 25 | 50 | 50 | 50 |
| 51 | TREMOLO STRINGS | 1 | 1 | 51 | 51 |
| 52 | SYNTHESIZED STRINGS 1 | 1 | 26 | 52 | 52 |
| 53 | STRINGS 3 | 1 | 26 | 53 | 53 |
| 54 | VIOLIN 2 | 2 | 2 | 54 | 54 |
| 55 | CELLO | 2 | 2 | 55 | 55 |
| ⋮ | ⋮ | ⋮ | ⋮ | ⋮ | ⋮ |
| 100 | UPRIGHT BASS | 25 | 50 | 100 | 100 |
| 101 | STRINGS 4 | 1 | 26 | 26 | 101 |
| 102 | SYNTHESIZED STRINGS 2 | 1 | 26 | 52 | 102 |
| 103 | STRINGS 5 | 1 | 26 | 53 | 103 |
| 104 | VIOLIN 3 | 2 | 2 | 2 | 104 |
| 105 | VIOLIN 4 | 2 | 2 | 54 | 105 |
| 106 | PIZZICATO VIOLIN SOLO | 2 | 2 | 2 | 106 |
| ⋮ | ⋮ | ⋮ | ⋮ | ⋮ | ⋮ |
| 200 | CONTRABASS 2 | 25 | 25 | 25 | 200 |
| 201 | STRINGS 6 | 1 | 26 | 26 | 101 |
| 202 | SYNTHESIZED STRINGS 3 | 1 | 26 | 52 | 52 |
| 203 | HARP | 2 | 2 | 2 | 2 |
| ⋮ | ⋮ | ⋮ | ⋮ | ⋮ | ⋮ |
| 299 | CONTRABASS 3 | 25 | 25 | 25 | 25 |
| 300 | CONTRABASS 4 | 25 | 25 | 25 | 25 |

FIG.3 (TONE-COLOR-NUMBER CONVERSION TABLE)

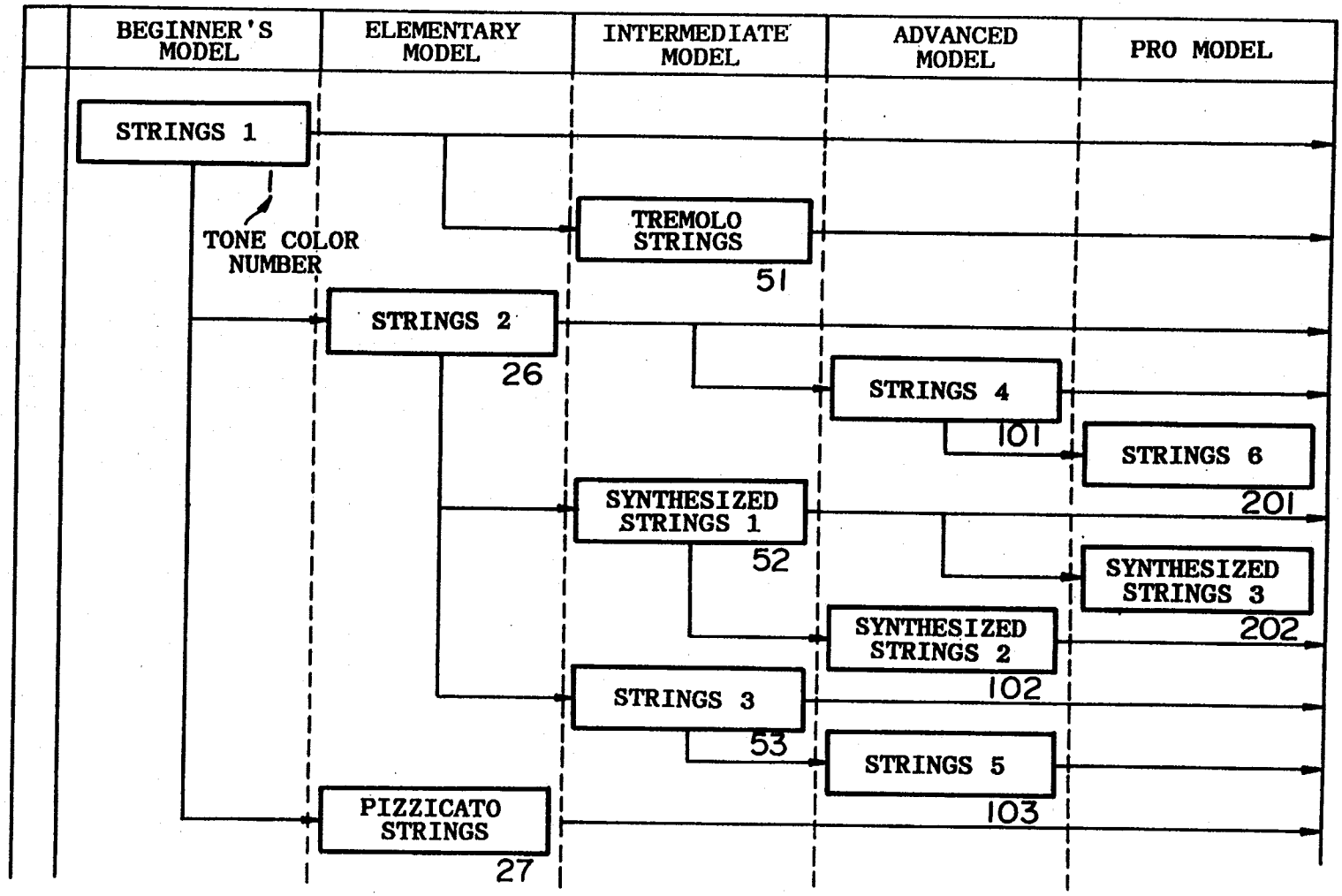
FIG. 4 (TREE-STRUCTURE DIAGRAM OF TONE-COLOR CORRESPONDING SYSTEM -STRINGS-)

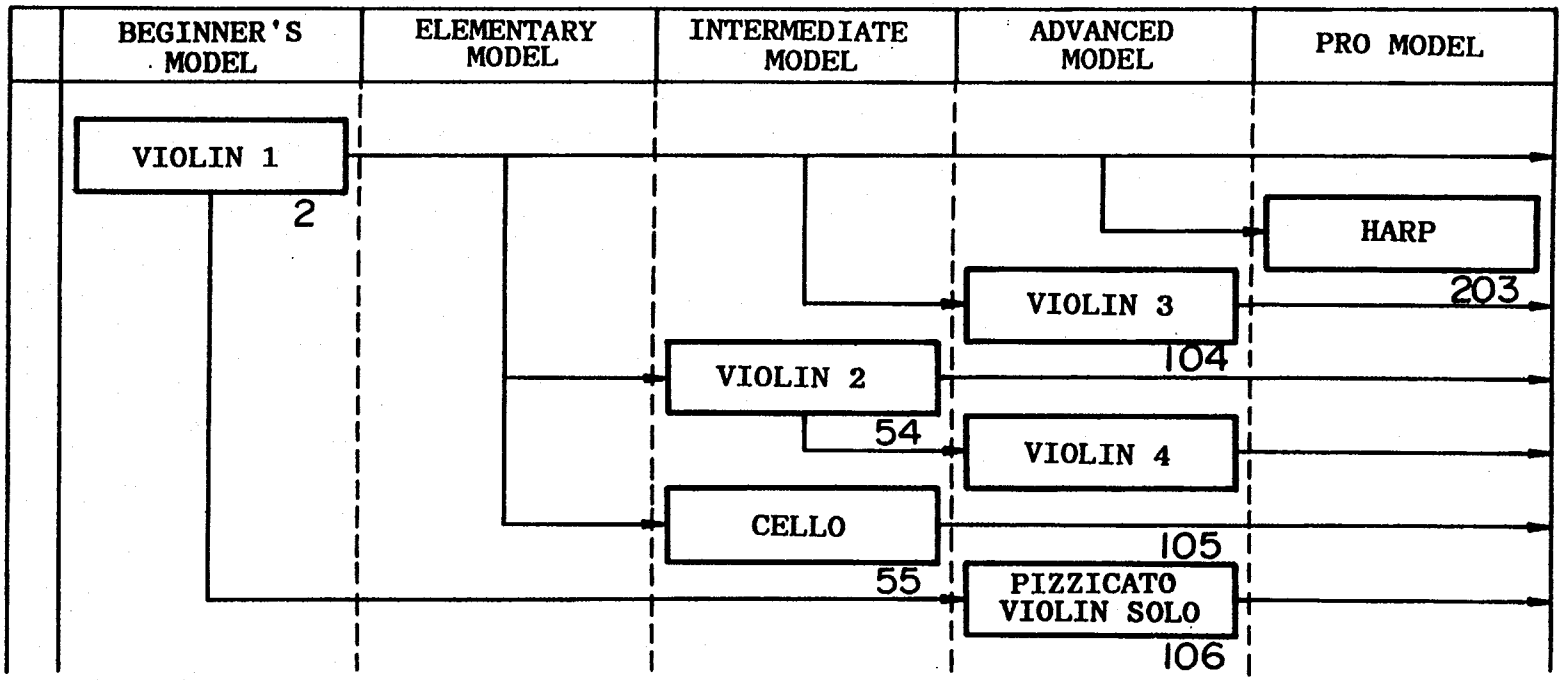
FIG. 5 (TREE-STRUCTURE DIAGRAM OF TONE-COLOR CORRESPONDING SYSTEM -VIOLIN-)

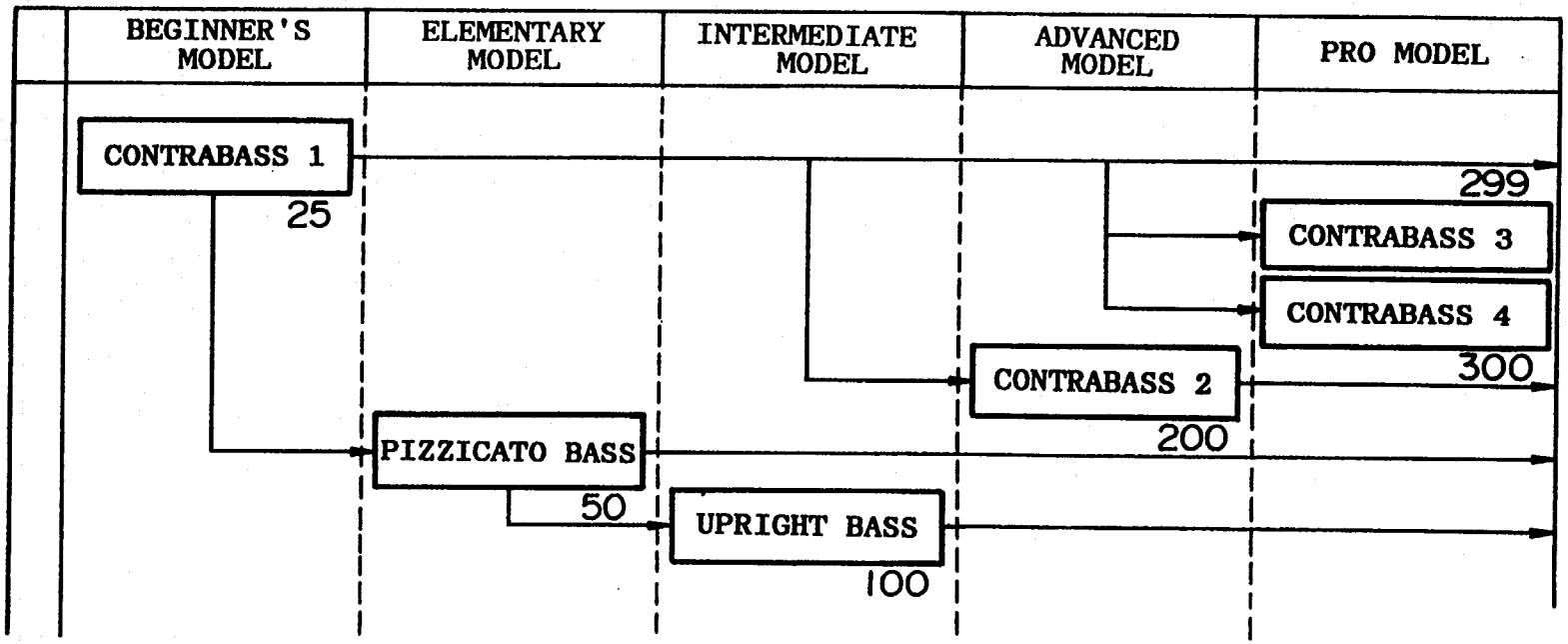
FIG.6 (TREE-STRUCTURE DIAGRAM OF TONE-COLOR CORRESPONDING SYSTEM -CONTRABASS-)

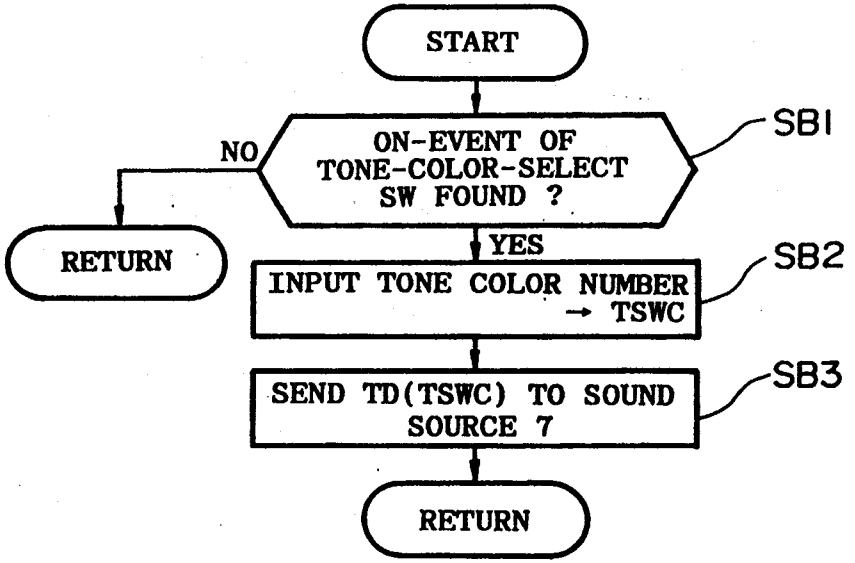
FIG. 8 (TONE-COLOR-SELECT-SWITCH PROCESS ROUTINE)
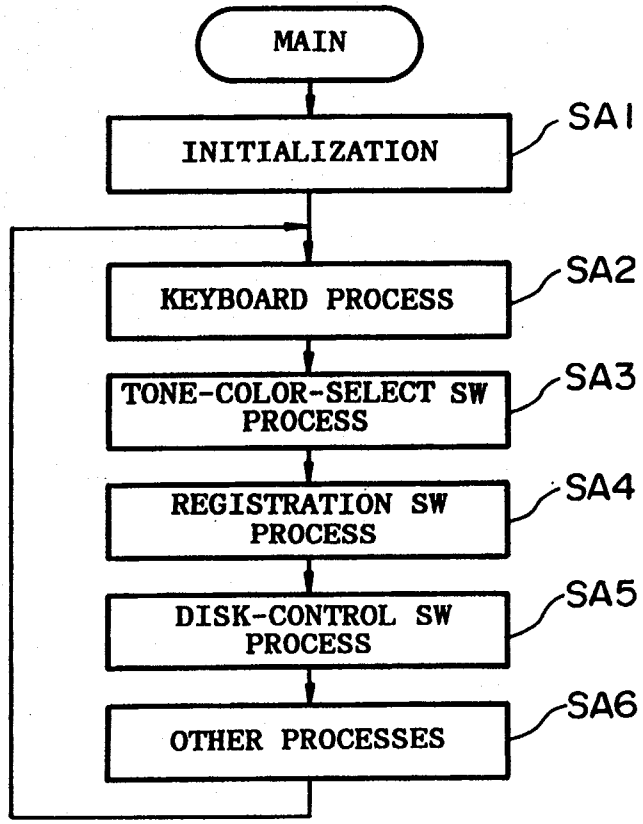
FIG. 7 (MAIN ROUTINE)

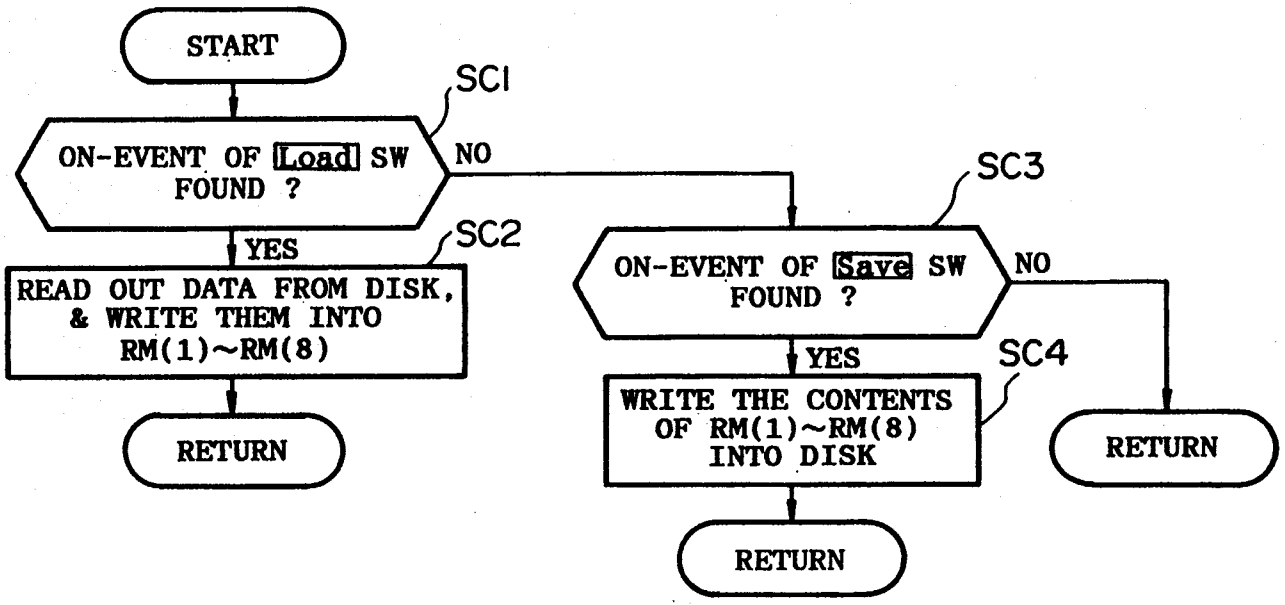
FIG. 9 (DISK-CONTROL-SWITCH PROCESS ROUTINE).

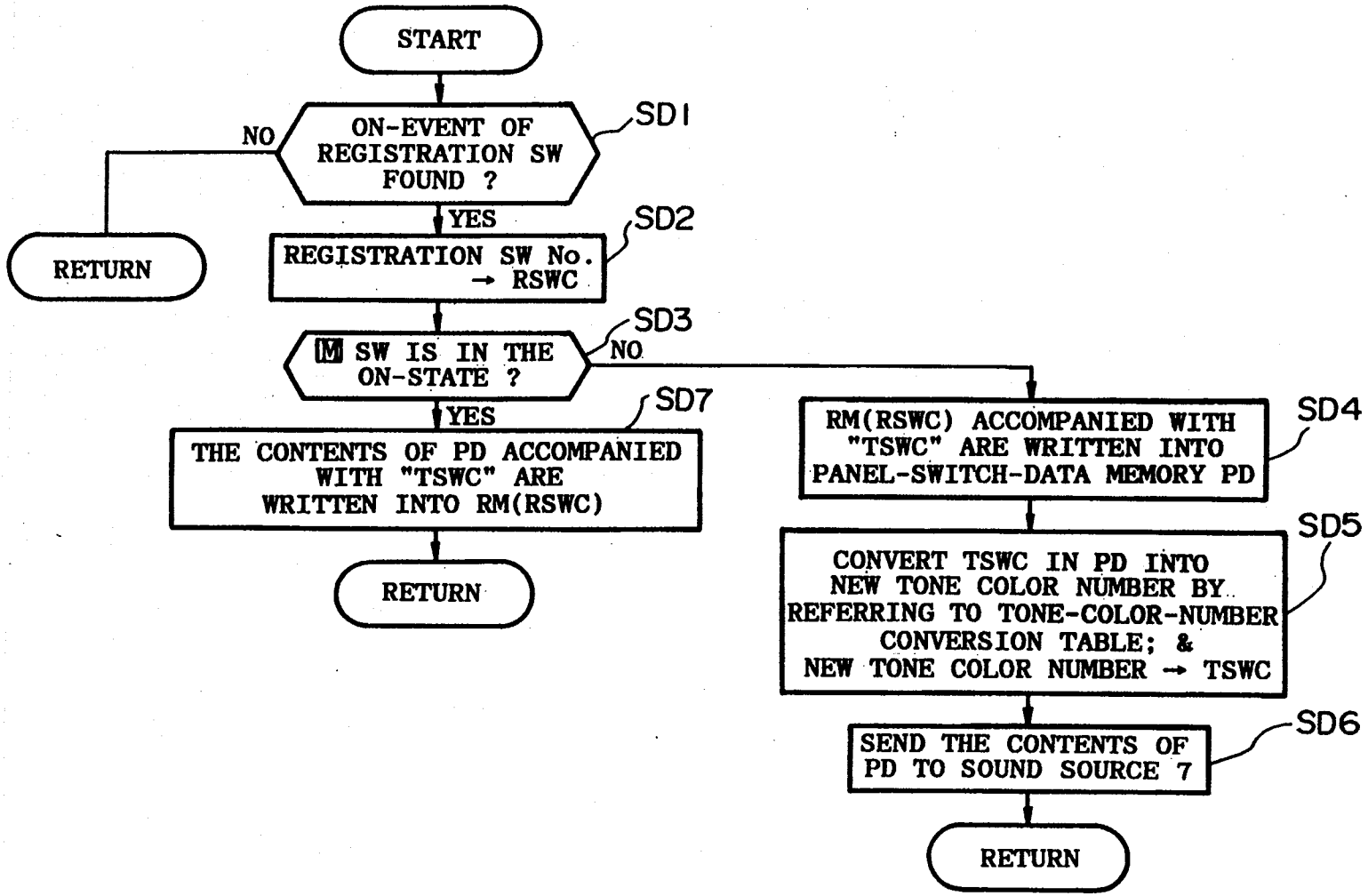
FIG. 10 (REGISTRATION-SWITCH PROCESS ROUTINE)

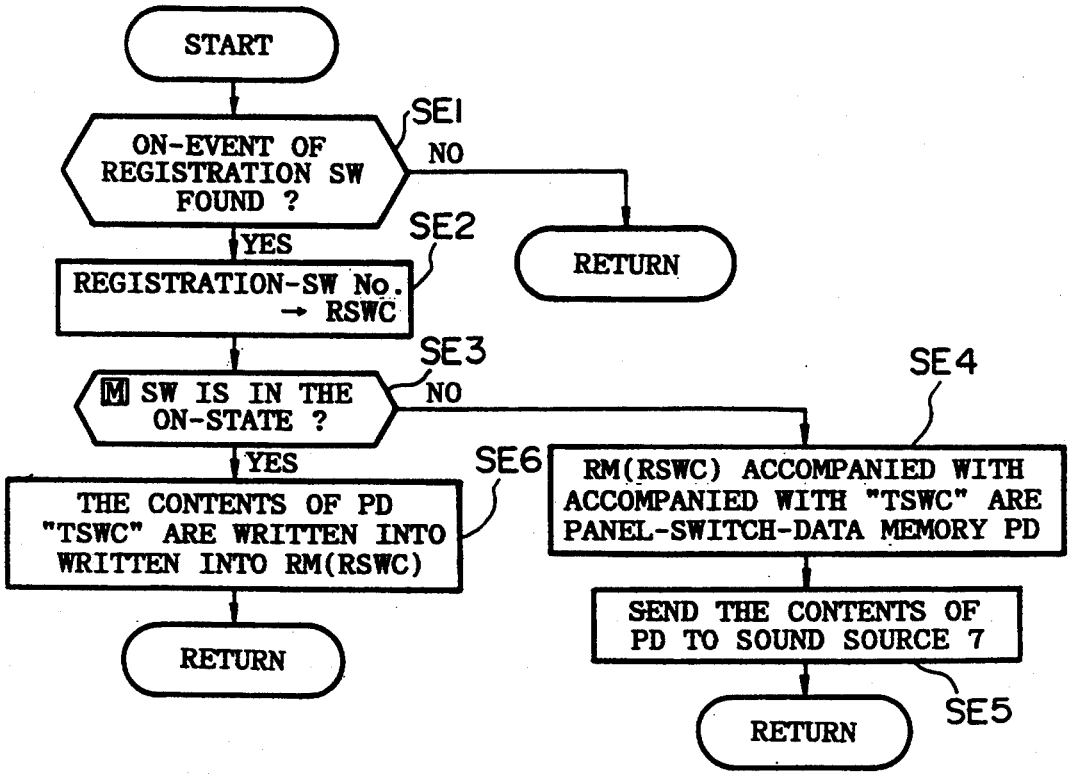
FIG.11 (REGISTRATION-SW PROCESS ROUTINE)

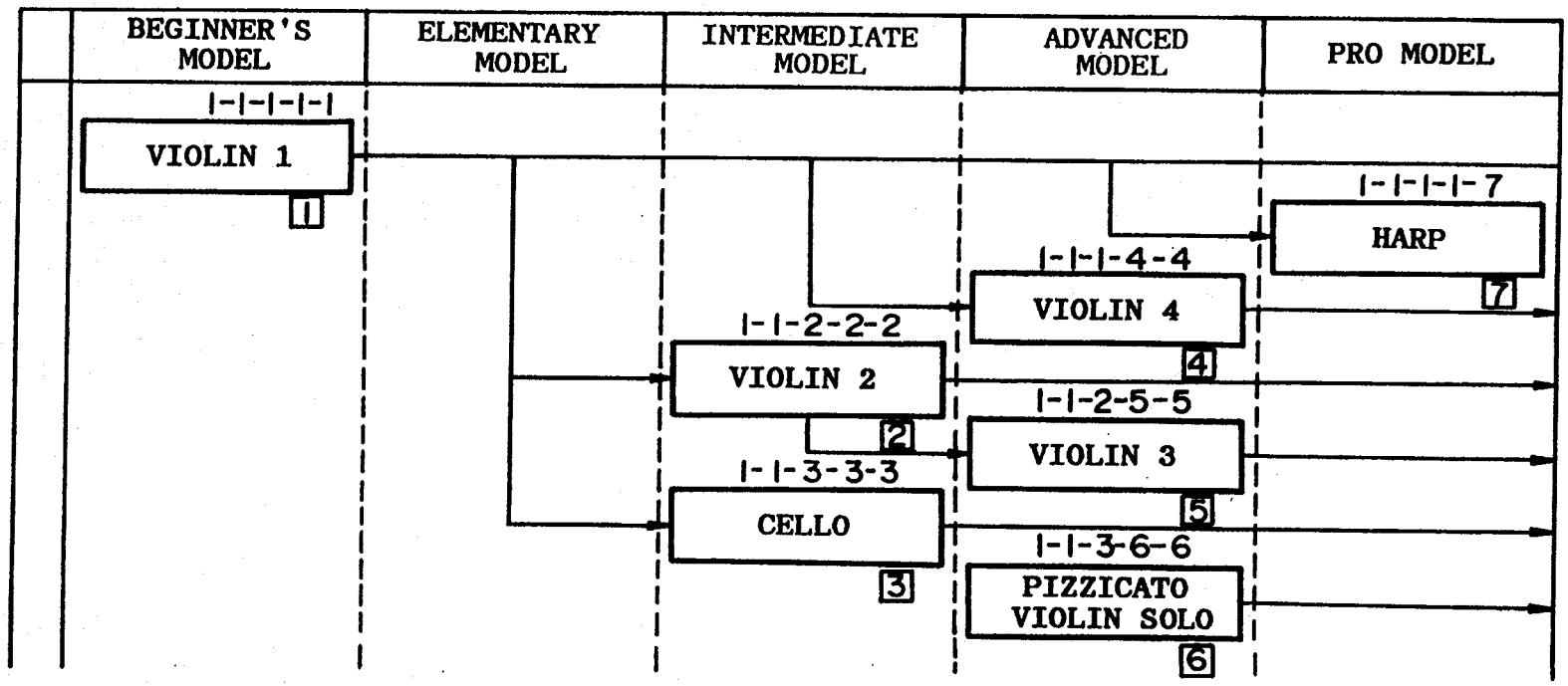
FIG. 12 (TREE-STRUCTURE DIAGRAM OF TONE-COLOR CORRESPONDING SYSTEM -VIOLIN-)

ELECTRONIC MUSICAL INSTRUMENT HAVING DATA COMPATIBILITY AMONG DIFFERENT-CLASS MODELS

BACKGROUND OF THE INVENTION

1. Field of the Invention

The present invention relates to an electronic musical instrument capable of generating musical tones in response to tone colors, accompaniment patterns and the like which are memorized in advance.

2. Prior Art

In general, the current model of an electronic musical instrument stores the musical tone control data (e.g., parameters) and performance information in the external memory unit, such as the floppy-disk unit. Its operation panel provides several kinds of switches and controls, by which the musical tone control data, determining characteristics of the musical tones, are set. In this case, one model of the electronic musical instrument transmits such data and information to another model by use of the MIDI (i.e., Musical Instrument Digital Interface) converter and the like, for example. The above-mentioned parameters and information represent the tone colors, accompaniment patterns and the like.

In another mode of the electronic musical instrument which receives the musical tone control data and performance information, musical tone signals are created on the basis of those data and information.

Meanwhile, the same models of the electronic musical instruments can share the same musical tone control data, e.g., tone colors, tone color numbers and accompaniment patterns concerning the musical tones to be generated. In other words, "data correspondence" is established between the same models of the electronic musical instruments. Therefore, the same musical tone control data can be commonly used among the same models of the electronic musical instruments without modifying them. However, between different models of the electronic musical instruments, the above-mentioned data correspondence is not established. Thus, there is a drawback in that the conventional electronic musical instrument cannot generate musical tones on the basis of the musical tone control data transmitted from the different model of the electronic musical instrument.

Conventionally, there are provided several kinds of models of the electronic musical instruments, e.g., beginner's model, elementary model, professional model (or pro model) and the like. In these models, the upper-class models (e.g., pro model) provide a larger number of tone colors, as compared to those of the lower-class models (e.g., elementary model). In other words, the lower-class model of the electronic musical instrument merely provides some of the tone colors which are provided in the upper-class model of the electronic musical instrument.

As described above, some of the musical tone control data which are created in the upper-class model of the electronic musical instrument are not used in the lower-class model of the electronic musical instrument. Because, the musical tone control data created by the upper-class model may contain data of the tone colors which are not provided in the lower-class model. Thus, the lower-class model of the electronic musical instrument cannot generate the musical tones on the basis of such musical tone control data created by the upper-class model of the electronic musical instrument.

SUMMARY OF THE INVENTION

It is accordingly a primary object of the present invention to provide an electronic musical instrument which can share the musical tone control data created by the different model of the electronic musical instrument.

Herein, the present invention relates to an electronic musical instrument which generates the musical tone signals on the basis of the predetermined musical tone control data which can be commonly used among different models of the electronic musical instruments.

In a first aspect of the present invention, there is provided an electronic musical instrument, which generates a musical tone on the basis of the predetermined musical tone control data thereof, comprising:

a conversion means containing a data table which memorizes a relationship among several kinds of musical tone control data each of which is specifically defined by each of different electronic-musical-instrument models, the conversion means converting musical tone control data of one of said different electronic-musical-instrument models into the predetermined musical tone control data by referring to the data table; and a musical tone creating means for creating a musical tone signal on the basis of the predetermined musical tone control data.

In a second aspect of the present invention, there is provided an electronic musical instrument, which generates a musical tone on the basis of the predetermined musical tone control data thereof, comprising:

an external memory means for storing a series of data which is related to several kinds of musical tone control data respectively corresponding to different electronic-musical-instrument models; and a musical tone creating means for reproducing the predetermined musical tone control data from a series of data and creating a musical tone signal on the basis of the predetermined musical tone control data.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings:

FIG. 3 shows an example of a tone-color-number conversion table used in the embodiment;

FIGS. 4 to 6 are tree-structure diagrams respectively showing tone-color corresponding systems for strings-type, violin-type and contrabass-type tone colors;

FIG. 7 is a flowchart showing a main routine;

FIG. 8 is a flowchart showing a tone-color-select switch process routine;

FIG. 9 is a flowchart showing a disk-control switch process routine;

FIG. 10 is a flowchart showing a registration-switch process routine employed in the beginner's model;

FIG. 11 is a flowchart showing another registration-switch process routine employed in the pro model;

FIG. 12 is a tree-structure diagram showing a tone-color corresponding system for the violin-type tone color, according to a modified example of the embodiment.

DESCRIPTION OF THE PREFERRED EMBODIMENTS

Figure 1:
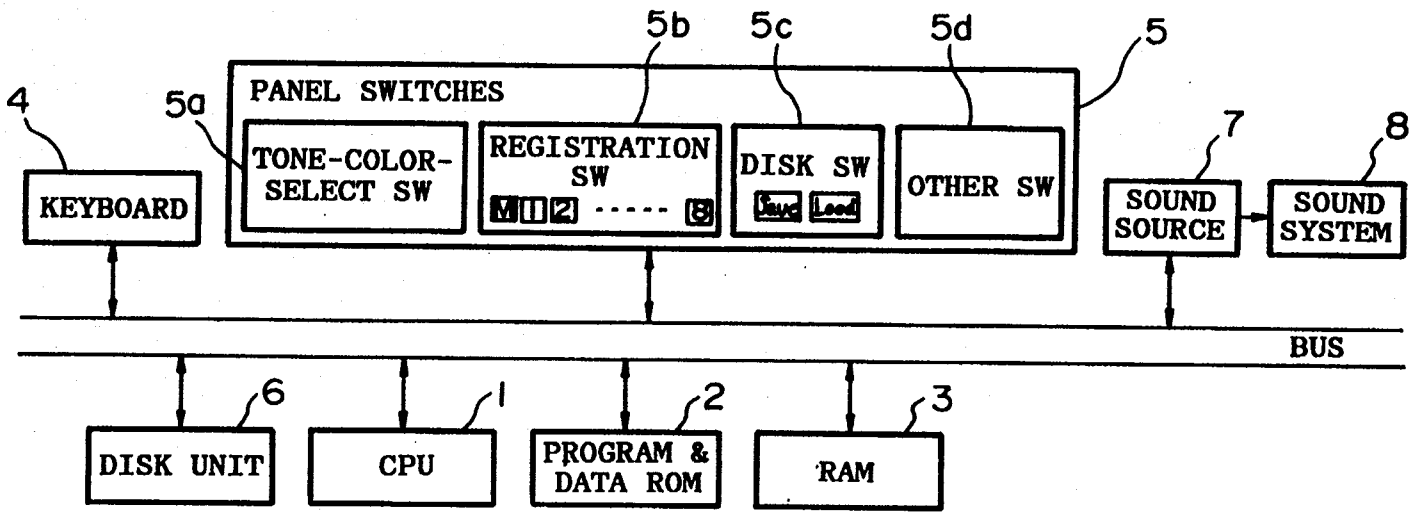
FIG. 1 is a block diagram showing an electric configuration of an electronic musical instrument according to an embodiment of the present invention.

Next, description will be given with respect to the electronic musical instrument according to an embodiment of the present invention by referring to the drawings.

[A] Configuration

FIG. 1 is a block diagram showing an electric configuration of the electronic musical instrument according to an embodiment of the present invention. In FIG. 1, 1 designates a central processing unit (i.e., CPU) which controls several portions of this electronic musical instrument in accordance with the predetermined programs stored in a read-only memory (i.e., ROM). In addition, this ROM 2 also stores several kinds of processes of the present embodiment, which will be described later. The CPU 1 temporarily stores some data, to be obtained when performing several kinds of controls, in a random-access memory (i.e., RAM) 3. In addition, this RAM 3 is also used as a working area which temporarily stores several kinds of registers and flags.

Further, 4 designates a keyboard containing plural white and black keys, which creates performance information (containing key-on signals, key-off signals, velocity signals, etc.) and then outputs it to the CPU 1 via a bus.

Meanwhile, 5 designates an operation panel, providing tone-color-select switches 5*a*, registration switches 5*b*, disk switches 5*c* and other switches 5*d*.

Further, 6 designates a disk unit. This disk unit 6 is provided as the external memory unit which records performance information and performance parameters set by operating the switches of the operation panel 5. As the recording medium used in this external memory unit, the floppy disk is used.

Next, 7 designates a sound source which creates digital musical tone signals in accordance with the performance information and musical tone information supplied thereto via the bus. These digital musical tone signals are supplied to a sound system 8. This sound system 8 converts the digital musical tone signals into the analog musical tone signals, by which corresponding musical tones are sounded from speakers.

Figure 2:
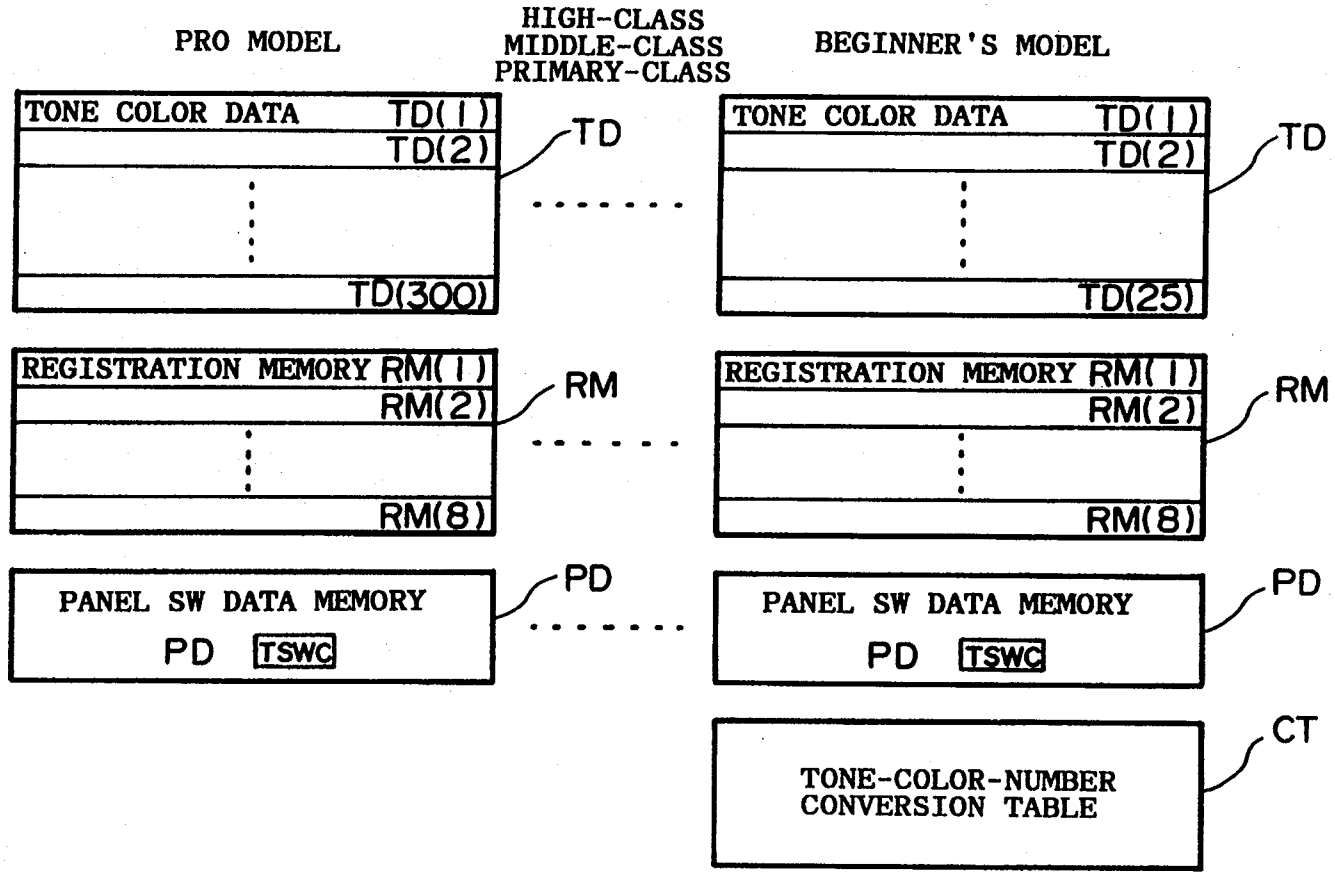
FIG. 2 is a drawing showing a relationship of memory configuration between different models of the electronic musical instruments.

Next, description will be given with respect to registration data which are commonly used among different models of the electronic musical instruments, by referring to FIG. 2. Herein, as an example of the registration data, data concerning the tone colors will be explained. In FIG. 2, the beginner's model provides twenty-five kinds of tone color data TD(1) to TD(25), for example. These data are stored in the ROM 2. In contrast, as for the other models, the elementary model provides fifty kinds of tone color data; the intermediate model provides one-hundred kinds of tone color data; the advanced model provides two-hundreds kinds of tone color data; and pro model provides three-hundreds kinds of tone color data. FIG. 2 also shows the tone color data TD(1) to TD(300) used in the pro model.

Among these models, from beginner's model to pro model, the same tone color number is set to indicate the same tone color. For example, the tone color data TD(1) of the beginner's model is identical to that of the pro model. In other words, the beginner's model can generate the musical tones by using the tone color data (1) set in the pro model. In contrast, the tone color data TD(300) of the pro model is not provided in the beginner's model, therefore, the beginner's model cannot generate the musical tones by using such data TD(300) as it is. As described above, each of the different models of the electronic musical instruments provides different number or kinds of the tone color data.

On the other hand, all of the different models of the electronic musical instrument provide eight registration memories RM(1) to RM(8) as a memory area which memorizes the registration data. These registration memories RM(1) to RM(8) are provided in the RAM 3, wherein each of them can store the registration data (one of which corresponds to the tone color number representing the tone color data).

Herein, there are provided two kinds of the registration data to be stored in the registration memories RM(1) to RM(8).

One of them is the performance information which is set by operating the switches, etc. of the operation panel 5. More specifically, the registration memories store the registration data which are set by operating the operation panel 5 of the electronic musical instrument. Actually, such storing operation may be performed by means of a panel switch data memory PD, which will be described later. Then, the performance is played on the basis of the stored data, or the stored data are further written into the floppy disk by the disk unit 6. Herein, each of the registration memories RM(1) to RM(8) are selected by operating each of the registration switches 5*b* shown in FIG. 1.

The other is the registration data which are stored in the external memory means, such as the floppy disk, in advance. In this case, these data are read out and then written into the registration memories RM(1) to RM(8). As described before, each of these memories is selected by operating each of the registration switches 5*b*.

Meanwhile, all models of the electronic musical instruments provide the panel switch data memory PD which contains a register TSWC so as to store the tone color numbers. This memory PD store the operating state of each switch provided in the operation panel 5 (hereinafter, simply referred to as panel-switch data). This memory PD performs the data transmission of the panel-switch data between the registration memories RM(1) to RM(8) and sound source 7.

Next, description will be given with respect to a tone-color-number conversion table CT. This table CT is used to convert the tone color data among the different models of the electronic musical instruments, i.e., beginner's model, elementary model, intermediate model, advanced model and pro model. In short, this table CT is referred when converting the tone color number of the upper-class model into the tone color number for the lower-class model. Therefore, the pro model, i.e., the highest-class model, does not provide such tone-color-number conversion table CT. In contrast, models other than the pro model, e.g., advanced model, intermediate model and elementary model, all provide the tone-color-number conversion table CT (not shown in FIG. 2).

Next, detailed description will be given with respect to the contents of the tone-color-number conversion table CT by referring to FIG. 3. In the tone-color-number conversion table CT as shown in FIG. 3, all of the tone color numbers provided in the pro model are connected with the tone color numbers of the lower-class model. In FIG. 3, numbers "1" to "300" correspond to the tone color numbers TSWC representing the tone colors provided in the pro model. More specifically, the tone color number TSWC "1" corresponds to the tone color name "strings 1"; and another tone color number "2" corresponds to another tone color name "violin 1". Similarly, number "25" corresponds to "contrabass 1"; "26" corresponds to "strings 2"; "27" corresponds to "pizzicato strings"; . . . ; "299" corresponds to "contrabass 3"; and "300" corresponds to "contrabass 4".

FIG. 3 also shows the tone color numbers TSWC of the lower-class models in connection with those of the pro model. As described before, the beginner's model provides twenty-five kinds of the tone colors, represented by the tone color numbers TSWC "1" to "25". Therefore, these tone color numbers TSWC "1" to "25" of the beginner's model are corresponded with the tone color numbers TSWC "1" to "300" of the pro model. Herein, the tone color numbers "1" to "25" of the pro model are respectively and directly corresponded with the tone color numbers "1" to "25" of the beginner's model. Then, the tone color number "26" of the pro model is corresponded with the tone color number "1" of the beginner's model; "50" of pro model is corresponded with "25" of beginner's model; and "51" to "53" of pro model are all corresponded with "1" of beginner's model. In addition, "54" and "55" of pro model are both corresponded with "2" of beginner's model. And, the other tone color numbers, from "56", of the pro model are respectively corresponded with any one of the tone color numbers "1" to "25" of the beginner's model.

Meanwhile, the elementary model provides fifty kinds of tone colors, represented by the tone color numbers TSWC "1" to "50". Therefore, each of the tone color numbers "1" to "300" of the pro model is corresponded with any one of the tone color numbers "1" to "50" of the elementary model.

Similarly, the tone color numbers "1" to "300" of the pro model are respectively corresponded with the tone color numbers "1" to "100" of the intermediate model and "1" to "200" of the advanced model.

For the convenience' sake, the above-described contents of the tone-color-number conversion table CT, as shown in FIG. 3, is set such that the tone color numbers of the pro model are set as the reference numbers and the tone color numbers of the lower-class models are respectively connected with such reference numbers. However, in the actual tone-color-number conversion table CT, each tone color number TSWC representing the specific instrument is set corresponding to the predetermined number of each model. For example, the tone color number TSWC "1", representing "strings 1", is corresponded with the tone color number "1" of pro model, "1" of advanced model, "1" of intermediate model, "1" of elementary model and "1" of beginner's model. Therefore, by using this table CT, it is possible to freely access to the tone color number TSWC of the different model. For example, the tone color number TSWC "55" representing "cello" is corresponded with the tone color number "55" of pro model, "55" of advanced model, "55" of intermediate model, "2" of elementary model and "2" of beginner's class model. Therefore, the tone color number "55" of the intermediate model is converted into "2" for the elementary model.

Next, description will be given with respect to the tone-color corresponding system by referring to the tree-structure diagrams as shown in FIGS. 4 to 6.

FIG. 4 shows a relationship between the tone color "strings" and tone color numbers TSWC of each model. This tone color "strings" has some variations, e.g., "strings 2", "strings 3", . . . , "tremolo strings", "synthesized strings 1", etc. Each of these kinds of the strings has its original tone color. For example, the original tone color of "strings 6" (represented by tone color number TSWC="201") is "strings 4" (represented by tone color number TSWC="101"), while the original tone color of this "strings 4" is "strings 2" (represented by tone color number TSWC="26").

Further, the original tone color of "strings 2" is the tone color of "strings 1" (represented by the tone color number TSWC="1"). In other words, the above-mentioned tone colors of "strings 4" (i.e., TSWC="101"), "synthesized strings 1" (i.e., TSWC="52") and "strings 3" (i.e., TSWC="53") are derived from the tone color of "strings 2". In addition, "strings 6" (i.e., TSWC="201") is derived from "strings 4", while "synthesized strings 3" (i.e., TSWC="202") is derived from "synthesized strings 1". Each of these tone colors is derived from its most-similar, original tone color. Such correspondence between the tone colors is established in the tree structure in the tone-color-number conversion table CT.

When studying such tone-color correspondence from another aspect, the beginner's model only provides the tone color of "strings 1" as the strings-type tone color. On the other hand, the elementary model provides the tone colors of "strings 2" and "pizzicato strings" (i.e., TSWC="27") other than "strings 1". For this reason, the above-mentioned three tone colors of "strings 1", "strings 2" and "pizzicato strings" provided in the elementary model are all corresponded with their original tone color of "strings 1" in the beginner's model.

Similar tone-color correspondence represented by the tree-structure system as shown in FIG. 4 is established among the other models.

FIG. 5 shows a tree-structure, tone-color corresponding system concerning the tone color of violin. As shown in FIG. 5, the tone color of violin has several variations, such as "violin 2", "violin 3", . . . , "cello", "pizzicato violin solo", etc. As similar to the foregoing tone-color variations of the strings, each variation of the tone color of violin has its original tone color. More specifically, all of the tone colors of "harp" (i.e., TSWC="203"), "violin 3" (i.e., TSWC="104"), "violin 2" (i.e., TSWC="54"), "cello" (i.e., TSWC="55") and "pizzicato violin solo" (i.e., TSWC="106") have one original tone color of "violin 1" (i.e., TSWC="2"). In addition, the original tone color of "violin 4" (i.e., TSWC="105") is "violin 2". Each of these tone colors is derived from its most-similar, original tone color. Such tone-color correspondence among them is established in the tree structure in the tone-color-number conversion table CT.

By referring to FIG. 5, description will be given with respect to the tone-color correspondence established between the advanced model and elementary model.

Herein, the advanced model provides six tone colors of "violin 1", "violin 3", "violin 2", "violin 4", "cello" and "pizzicato violin solo" as the violin-type tone color, while the elementary model provides only one tone color of "violin 1". Therefore, "violin 3" of the advanced model is corresponded with its most-similar, original tone color of "violin 1" in the elementary model. In addition, "violin 2" and "violin 4" of the advanced model are corresponded with "violin 1" of the elementary model by means of "violin 2" of the intermediate model. Similarly, "cello" and "pizzicato violin solo" of the advanced model are both corresponded with "violin 1" of the elementary model.

Thus, the tone-color correspondence, concerning the violin-type tone color, is established among the other models on the basis of the tree-structure system as shown in FIG. 5.

FIG. 6 shows a tree-structure, tone-color corresponding system concerning the contrabass-type tone color. In FIG. 6, this contrabass-type tone color has several variations, such as "contrabass 2", "contrabass 3", . . . , "pizzicato bass", "upright bass", etc. As similar to the foregoing strings-type and violin-type tone colors, each of these contrabass-type tone colors has its original tone color. More specifically, "contrabass 3" (i.e., TSWC="299"), "contrabass 4" (i.e., TSWC="300"), "contrabass 2" (i.e., TSWC="200") and "pizzicato bass" (i.e., TSWC="50") have the same, original tone color of "contrabass 1" (i.e., TSWC="25"). In addition, the original tone color of "upright bass" (i.e., TSWC="100") is "pizzicato bass". Each of the other contrabass-type tone colors is derived from its most-similar, original tone color. Such tone-color correspondence, concerning the contrabass-type tone color, is established in the tree structure in the tone-color-number conversion table CT.

By referring to FIG. 6, description will be given with an example of the tone-color correspondence established between the pro model and advanced model. Herein, the pro model provides all of the tone colors of "contrabass 1", "contrabass 3", "contrabass 4", "contrabass 2", "pizzicato bass" and "upright bass" as the contrabass-type tone color. On the other hand, the advanced model provides some of them, i.e., "contrabass 1", "contrabass 2", "pizzicato bass" and "upright bass". For this reason, "contrabass 1", "contrabass 3" and "contrabass 4" of the pro model are all corresponded with their most-similar, original tone color of "contrabass 1" in the advanced model. In addition, "contrabass 2", "pizzicato bass" and "upright bass" are respectively and directly corresponded with "contrabass 2", "pizzicato bass" and "upright bass".

Similarly, the predetermined tone-color correspondence concerning the contrabass-type tone color is established among the other models on the basis of the tree-structure, tone-color corresponding system as shown in FIG. 6.

[B] Operation

Next, description will be given with respect to the operations of the electronic musical instrument according to the present embodiment by referring to the flowcharts shown in FIGS. 7 to 10. For convenience sake, description of the operations will be given with respect to the beginner's model.

First, after the power switch (not shown) is turned on in the present electronic musical instrument, the floppy disk, of which data are made by the pro model, is inserted into the disk unit 6 so that the registration data are sequentially written into the registration memories RM, for example.

Now, description will be given with respect to the detailed procedures to be required in the above-mentioned operation.

When the performer turns on the power switch, the CPU 1 starts to execute the processes of main routine as shown in FIG. 7. Then, the floppy disk is inserted into the disk unit 6, and the performer depresses down the "Load" switch provided in the disk switches 5c.

In first step SA1 of this main routine, several kinds of the registers and flags are initialized. In next step SA2, the CPU 1 performs the keyboard process wherein the CPU 1 scans the keyboard 4 so as to detect the key-depression and/or key-release event and then input the performance information.

In step SA3, the CPU 1 carries out the tone-color-select switch process routine as shown in FIG. 8. In first step SB1 of this routine, it is Judged whether or not the tone-color-select switch 5a is depressed down. If this switch 5a is depressed down, the judgment result of this step SB1 turns to "YES", so that the processing proceeds to step SB2. In step SB2, the selected tone color number is written into the register TSWC. In next step SB3, the tone color data TD(TSWC) is sent to the sound source 7. Thereafter, the processing of the CPU 1 returns back to the main routine.

On the other hand, if the tone-color-select switch 5a is not operated, the Judgment result of step SB1 is "NO", so that the processing returns back to the main routine without executing any process of the tone-color-select switch process routine shown in FIG. 8.

In the main routine shown in FIG. 7, the processing proceeds to step SA4 wherein the CPU 1 executes the registration-switch process routine as shown in FIG. 10. In first step SD1 of this registration-switch process routine, it is judged whether or not the on-event is occurred in the registration switch 5b. In this case, the registration switch 5b is not operated, so that the Judgment result of step SD1 turns to "NO" and consequently the processing returns back to the main routine without executing any process of this routine.

In the main routine, the processing proceeds to step SA5 wherein the CPU 1 carries out the disk-control-switch process routine as shown in FIG. 9. In first step SC1 of this routine, it is judged whether or not the "Load" switch is depressed down. In this case, as described before, this "Load" switch is depressed down, so that the judgment result of step SC1 turns to "YES" and consequently the processing proceeds to step SC2.

In step SC2, the CPU 1 reads out the registration data from the floppy disk, and then writes it into the registration memories RM(1) to RM(8). When completing the process of step SC2, the processing returns back to the main routine.

In the main routine, the processing proceeds to step SA6 wherein the other processes are carried out. After that, the processing returns to the foregoing step SA2 again. Thus, the CPU 1 repeatedly performs the processes of the foregoing steps SA2 to SA6.

Next, in order to play the performance on the basis of the registration data written in the registration memories RM(1) to RM(8), the performer selects one of the registration switches 5b so as to select the desirable registration memory RM.

When any one of the registration switches numbered from "1" to "8" is depressed down, the judgment result of step SD1 shown in FIG. 10 turns to "YES", so that the processing proceeds to step SD2. In step SD2, number of the registration switch 5b to be depressed is written into the register RSWC. In next step SD3, it is Judged whether or not the registration switch Sb, represented by "M", is depressed down. In this case, such "M" switch is not depressed down, so that the Judgment result of step SD3 turns to "NO". Then, the processing proceeds to step SD4.

In step SD4, the contents of the registration memory RM(RSWC) accompanied with the tone color number TSWC are written into the panel-switch-data memory PD. In next step SDS, the tone color number TSWC stored in the panel-switch-data memory PD is converted into the new tone color number TSWC by referring to the foregoing tone-color-number conversion table CT. For example, the tone color of "pizzicato bass" corresponding to the tone color number TSWC="1" in the pro model is converted into the tone color of "contrabass 1" corresponding to the tone color number TSWC="25" in the beginner's model.

In step SD6, the contents of the panel-switch-data memory PD is sent to the sound source 7. In response to the supplied registration data, the sound source 7 sets the tone color and other parameters for the musical tones to be generated. Thereafter, the processing returns back to the main routine. Herein, the processing proceeds to step SA6 wherein the other processes are made. Then, the processing returns to step SA2, so that the CPU 1 repeats to execute the foregoing processes of step SA2 to SA6.

Next, description will be given with respect to the processes by which the registration memories RM memorize the operating states of the switches, to be operated by the performer, on the operation panel 5.

When the performer simultaneously depresses down both of the "M" switch and any one of the registration switches 5b (numbered from "1" to "8"), the CPU 1 accesses to step SA4 of the main routine so as to execute the registration-switch process routine shown in FIG. 10.

Under the above-mentioned state, the judgment result of step SD1 turns to "YES", so that the processing proceeds to step SD2 wherein number of the depressed registration switch 5b, i.e., any one of "1" to "8" is written into the register RSWC. In this case, one of the registration switches 5b and the "M" switch are simultaneously depressed down, therefore, the judgment result of step SD3 is "YES". Thus, the processing branches to step SD7 wherein the contents of the panel-switch-data memory PD accompanied with the tone color number TSWC are transferred to the registration memory RM(RSWC). Then, the processing returns back to the main routine. Herein, the processing proceeds to step SA6 wherein the other switch processes are made. Thereafter, the processing returns to step SA2, and consequently the CPU 1 repeats to execute the processes of steps SA2 to SA6.

Next, description will be given with respect to the writing operation in which the registration data stored in the registration memories RM(1) to RM(8) are written into the floppy disk.

When the performer depresses down the disk switch 5c, named "Save" switch, the CPU 1 executes the processes of disk-control switch process routine, as shown in FIG. 9, provided in the main routine. In this case, the "Save" switch is depressed down, so that the judgment result of step SC1 is "NO". Then, the processing branches to step SC3 wherein it is Judged whether or not the on-event is occurred with respect to the "Save" switch. Herein, the judgment result of step SC3 is "YES", so that the processing proceeds to step SC4.

In step SC4, the written contents of the registration memories RM(1) to RM(8) are written into the floppy disk. After completing the process of step SC4, the processing returns back to the main routine. In the main routine, the processing proceeds to step SA6 wherein the other switch processes are made. Then, the processing returns to step SA2 again. Thus, the CPU 1 repeats to executes the foregoing processes of steps SA2 to SA6.

The above-mentioned operations, which are set for the beginner's model, can be also applied to the other models other than the pro model, i.e., elementary model, intermediate model and advanced model. Within the above-mentioned routines, the pro model does not employ the registration-switch process routine as shown in FIG. 10, instead, the pro model employs another registration-switch process routine as shown in FIG. 11.

According to the registration-switch process routine shown in FIG. 11, in its first step SE1, it is udged whether or not the on-event is occurred with respect to any one of the registration switches 5b, numbered from "1" to "8". none of them is depressed down, the Judgment result of step SE1 turns to "NO", so that the processing returns back to the main routine.

On the other hand, if any one of the registration switches 5b is depressed down, the judgment result of step SE1 turns to "YES", so that the processing proceeds to step SE2. In step SE2, number of the depressed registration switch 5b is written into the register RSWC. In next step SE3, it is Judged whether or not the "M" switch provided within the registration switches 5b is depressed down, the Judgment result of step SE3 is "NO", the processing proceeds to step SE4.

In step SE4, the contents of the registration memory RM(RSWC) accompanied with the tone color number TSWC are written into the panel-switch-data memory PD. In next step SES, the written contents of the panel-switch-data memory PD is sent to the sound source 7. In response to the supplied registration data, the sound source 7 sets the tone color and other parameters of the musical tone to be generated.

In contrast, when the "M" switch and any one of the registration switches 5b are simultaneously depressed down, the judgment result of the foregoing step SE3 turns to "YES", so that the processing branches to step SE6. In step SE6, the contents of the panel-switch-data memory PD accompanied with the tone color number TSWC are transferred to the registration memory RM(RSWC). Then, execution of this routine is ended, and the processing returns back to the main routine.

As described above, the pro model does not carry out the conversion of the tone color number by referring to the tone-color-number conversion table CT.

[C] Modifications

Figure 13:
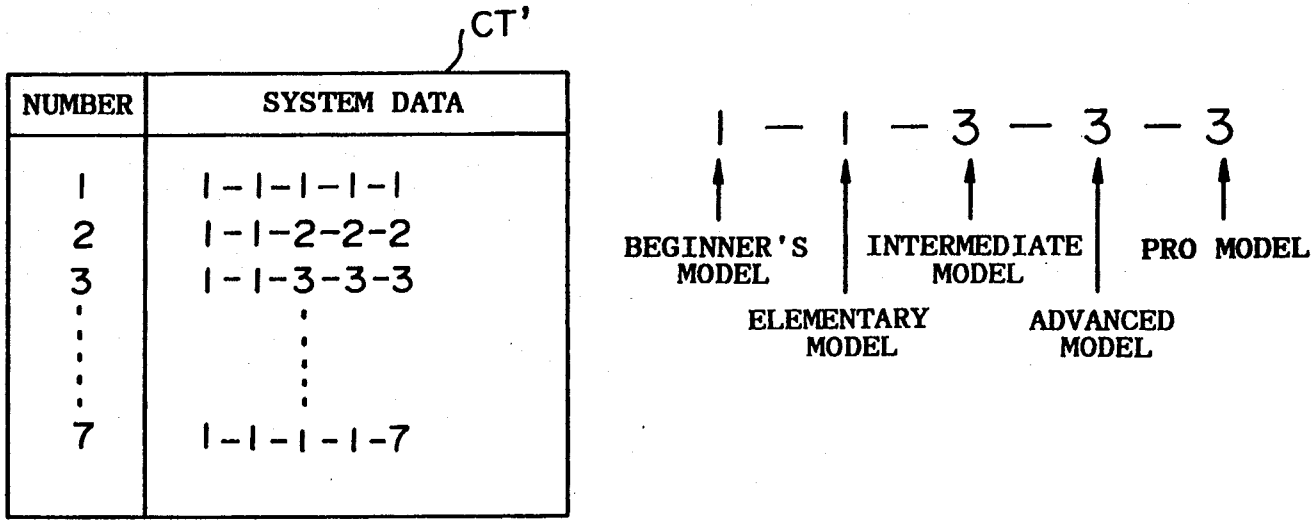
FIG. 13 is a diagram showing a data table used in the modified example of the embodiment.

Next, description will be given with respect to a modified example of the above-mentioned embodiment by referring to FIGS. 12, 13. FIG. 12 corresponds to FIG. 5, wherein a modified example of the tree-structure, tone-color corresponding system concerning the violin-type tone color is shown. Herein, both examples as shown in FIGS. 5, 12 are basically the same. However, this modified example computes a series of system data SD, as shown in FIG. 13, which are obtained on the basis of the tree-structure, tone-color corresponding system as shown in FIG. 12. And, these system data SD are sequentially written into the floppy disk as the tone color numbers TSWC.

In this modified example, the tone color of "violin 1", represented by the tone color number TSWC="1", is provided in all of the models. Therefore, a series of system data SD concerning "violin 1" can be represented as "1—1—1—1—1". Such system data SD indicates the tone color numbers TSWC of the beginner's model, elementary model, intermediate model, advanced model and pro model (see FIG. 13). For example, the tone color of "violin 4" (i.e., TSWC="4") is provided in the pro model and advanced model only. With respect to "violin 4", each of the tone color numbers TSWC, i.e., each of the system data SD of the other three models (i.e., beginner's model, elementary model and advanced model) is obtained from the contents of the tree-structure, tone-color corresponding system shown In FIG. 12. In this case, the tone color of the other tree models which corresponds to "violin 4" is "violin 1", represented by the tone color number TSWC="1". As a result, a series of system data SD concerning "violin 4" is represented as "1—1—1—4—4".

Further, the tone color of "violin 3" (i.e., TSWC="5") is provided in the pro model and advanced model only. As the tone color similar to "violin 3", the intermediate model provides "violin 2", while the beginner's model and elementary model provide "violin 1". In other words, the tone color of "violin 3" provided in the pro model and advanced model corresponds to "violin 2" of the intermediate model and "violin 1" of the beginner's model and elementary model. As a result, a series of system data SD concerning "violin 3" is represented as "1—1—2—5—5". The above-mentioned system data SD are memorized in form of the table SDT.

Thus, in the modified example, when writing the registration data into the floppy disk, the CPU 1 reads out the system data SD from the table SDT so as to write it into the floppy disk as the tone color number TSWC. On the other hand, when reading out the registration data from the floppy disk, the CPU 1 reads in the system data SD and then computes the tone color numbers TSWC by referring to this system data SD.

As described above, this invention may be practiced or embodied in still other ways without departing from the spirit or essential character thereof. For example, the foregoing embodiment can be further modified as follows.

(1) The foregoing embodiment employs the tree-structure, tone-color corresponding system when converting certain tone color into its similar tone color. However, when the tone-color conversion Is made with respect to a large number of tone colors of which number is larger than the number of the actually memorized tone colors, it is possible to modify the present embodiment such that the tone color is converted into or translated Into arbitrary one of the actually memorized tone colors.

(2) The foregoing embodiment refers to the sharing system of the tone color data, by which the tone color data of one model can be commonly used in another model. However, the present invention is not limited to such manner. In short, such sharing system can be applied to the other kinds of musical tone control data, such as the rhythm pattern data, sound-effect control data, accompaniment pattern data and touch data.

(3) The foregoing embodiment uses the conversion table or a series of system data in the tone-color-number converting operation. Instead, it is possible to use the other operation circuits or software operations.

(4) In the foregoing embodiment, the tone-color-number converting operation is made at a time when depressing down the registration switch 5*b*. This operation can be made at the other timings, i.e., at a time when reading out the registration data from the floppy disk or just prior to a timing when actually generating the musical tone.

(5) The foregoing modified example uses a series of system data with respect to the registration data. Such method can be applied to the other data, such as the tone color data to be preset and the other tone color data included in the recording data of the automatic performance. In this case, the automatic performance data can be commonly used among several models, for example.

(6) The foregoing embodiment uses the floppy disk as the external recording medium. Instead, it is possible to use the other recording media such as the magnetic card, magnetic tape, RAM cartridge, RAM card, optical recording medium, etc.

(7) The foregoing embodiment employs the beginner's model, elementary model, pro model and the like. Herein, each model has a different number of tone colors, however, the tone-color correspondence relationship among the different models can be represented as the tree-structure system. Instead, it is possible to use the other kinds of models, each concerning different musical genre and the like, in which the tone-color correspondence relationship cannot be represented by the tree-structure system. Or, it is possible to employ different kinds of models, each of which concerns the same level, e.g., people of the same performance-technique level. In short, the present invention can be applied to the electronic musical instrument in which the same kind of the musical tone control data can be shared among the different models.

As described heretofore, the preferred embodiment and its modified examples described herein are illustrative and not restrictive, the scope of the invention being indicated by the appended claims and all variations which come within the meaning of the claims are intended to be embraced therein.

What is claimed is:

1. An electronic musical instrument which generates a musical tone signal on the basis of predetermined musical tone control data thereof, comprising:

a conversion means containing a data table which memorizes a relationship among several kinds of musical tone control data, each of said kinds of musical tone control data corresponding to different electronic-musical-instrument models, said different electronic-musical-instrument models including at least a first model providing a first range of plural selectable tone characteristics determined by tone control data and a second model providing a second range of plural selectable tone characteristics greater than said first range, said conversion means for converting each of said kinds of musical tone control data into said predetermined musical tone control data by referring to said data table, said predetermined musical tone control data allowing musical tone control data of one of said electronic-musical-instrument models to be used interchangeably with another of said electronic-musical-instrument models; and a musical tone creating means for creating said musical tone signal on the basis of the predetermined musical tone control data.

2. An electronic musical instrument which generates a musical tone signal on the basis of predetermined musical tone control data thereof, comprising:

an external memory means for storing a series of data, said series of data being related to one of several kinds of musical tone control data respectively corresponding to different electronic-musical-instrument models, said different electronic-musical-instrument models including at least a first model providing a first range of plural selectable tone characteristics determined by tone control data and a second model providing a second range of plural selectable tone characteristics greater than said first range; and a musical tone creating means for reproducing said predetermined musical tone control data from said series of data and creating said musical tone signal on the basis of said predetermined musical tone control data, said predetermined musical tone control data allowing musical tone control data of one of said electronic-musical-instrument models to be used interchangeably with another of said electronic-musical-instrument models.

3. An electronic musical instrument which includes different electronic-musical-instrument models each of which generates a musical tone signal in accordance with predetermined musical tone control data, comprising:

a memory means for memorizing a data table representing a relationship among several kinds of musical tone control data each of which corresponds to one of said different electronic-musical-instrument models, said different electronic-musical-instrument models including at least a first model providing a first range of plural selectable tone characteristics determined by tone control data and a second model providing a second range of plural selectable tone characteristics greater than said first range;

a conversion means for converting each of said kinds of musical tone control data into said predetermined musical tone control data by referring to said data table, said predetermined musical tone control data allowing musical tone control data of one of said electronic-musical-instrument models to be used interchangeably with another of said electronic-musical-instrument models; and a musical tone creating means for creating said musical tone signal on the basis of said predetermined musical tone control data.

4. An electronic musical instrument as defined in any one of claims 1 to 3, wherein said predetermined musical tone control data represents a tone color of said musical tone to be generated.

5. An electronic musical instrument as defined in claim 1 or 3 wherein said predetermined musical tone control data represents a tone color of said musical tone to be generated so that said data table memorizes a relationship among the tone colors used in said different electronic-musical-instrument models.

6. An electronic musical instrument as defined in claim 1 or 3 wherein said predetermined musical tone control data represents a tone color of said musical tone to be generated and there are provided plural data tables each having the contents which represents a relationship among variations of the tone colors respectively used in the different electronic-musical-instrument models with respect to a predetermined original tone color.

* * * * *